United States Patent [19]

Kisler

[11] 4,402,035

[45] Aug. 30, 1983

[54] LOW VOLTAGE ELECTROSTATIC CHARGE REGULATING APPARATUS

[75] Inventor: Semyon Kisler, West Newton, Mass.

[73] Assignee: Polaroid Corporation, Cambridge, Mass.

[21] Appl. No.: 183,326

[22] Filed: Sep. 2, 1980

[51] Int. Cl.[3] ..... H05F 3/06

[52] U.S. Cl. ..... 361/213; 361/221; 361/229

[58] Field of Search ..... 361/213, 221, 229, 225; 250/324, 325, 326

[56] References Cited

U.S. PATENT DOCUMENTS

| | | | |
|---|---|---|---|
| 878,273 | 2/1908 | Chapman | 361/229 X |
| 2,774,921 | 12/1956 | Walkup | 250/325 X |
| 3,146,385 | 8/1964 | Carlson . | |
| 3,196,270 | 7/1965 | Rosenthal | 250/324 |
| 3,474,292 | 10/1969 | Carter | 361/213 |
| 3,670,203 | 6/1972 | Whitmore, Jr. et al. | 361/225 |
| 3,671,806 | 6/1972 | Whitmore et al. . | |
| 3,757,164 | 9/1973 | Binkowski . | |

FOREIGN PATENT DOCUMENTS

| | | | |
|---|---|---|---|
| 976027 | 11/1964 | United Kingdom | 361/225 |

OTHER PUBLICATIONS

"Controlling Polar Charge with Low Electrical Potentials", Andrews et al., 2/80, Research Disclosure.

*Primary Examiner*—Harry E. Moose, Jr.
*Attorney, Agent, or Firm*—John J. Kelleher

[57] ABSTRACT

A brush-like device having an array of conductive bristles is able to establish a relatively uniform dipole type electrostatic charge level on, for example, a moving web of charge-retaining material by passing said web through the relatively strong electrostatic field established by such a device when it is electrically connected to a relatively low potential DC source having the proper magnitude and polarity.

12 Claims, 10 Drawing Figures

FIG. 1A
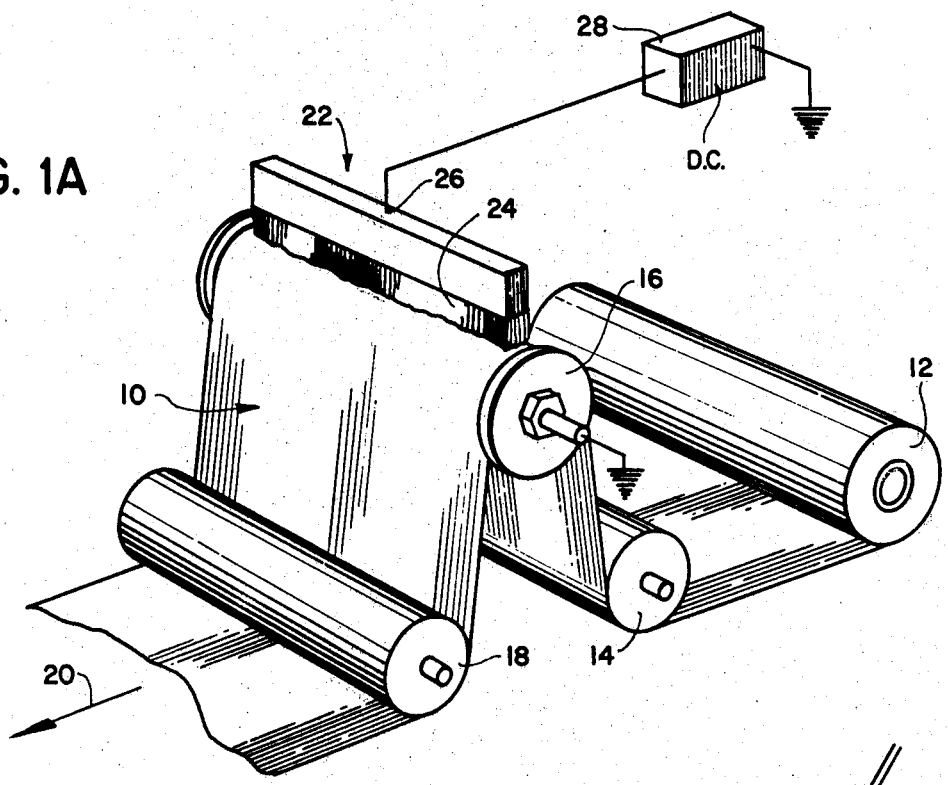
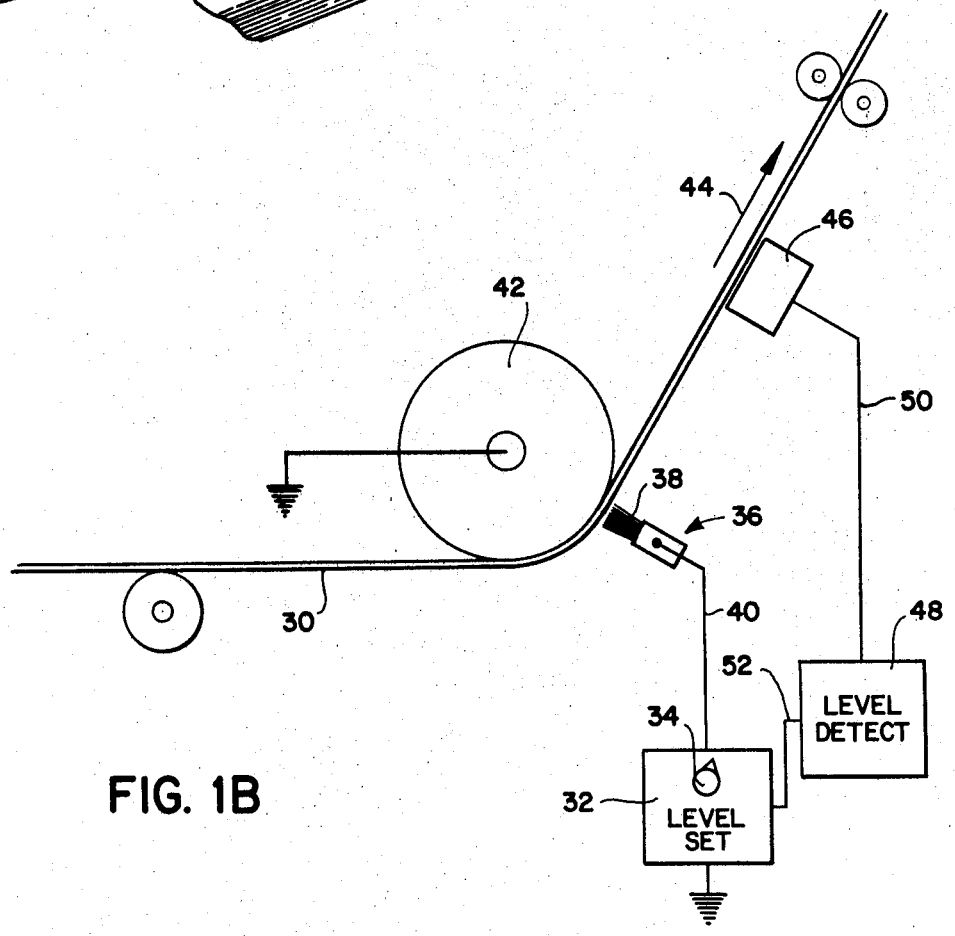
FIG. 1B

LOW VOLTAGE ELECTROSTATIC CHARGE REGULATING APPARATUS

BACKGROUND OF THE INVENTION

1. Field of the Invention

The present invention relates to apparatus for establishing a relatively uniform charge level on charge-retaining materials, in general, and to such apparatus for establishing such a charge level on a moving web of such material, in particular.

2. Description of the Prior Art

The presence of electrostatic charges on charge-retaining materials causes problems in many industries. In the photographic industry, for example, electrostatic charges on potential photographs or film units within a light-tight film cassette containing a plurality of film units for use in an "instant" type photographic camera, such as that sold by Polaroid Corporation, Cambridge, Mass., under its registered trademark SX-70, will often cling to one another with such intensity as a result of the force of attraction developed by such electrostatic charges, that proper ejection of an exposed film unit from said film cassette can be prevented if the effects of such charges are not controlled. In the SX-70 photographic film mentioned above, for example, electrostatic charges are controlled by controlling the charge levels on components of said film prior to final film assembly.

Troublesome electrostatic charges on charge-retaining materials can be conveniently thought of as falling into two categories. One category is that of polarization charges, sometimes referred to as dipoles, and the other is that of free surface charges. Polarization charges are bound to a definite site in a solid, whereas free surface charges are not. Free surface charges on a moving web of certain materials, for example, are frequently neutralized by a grounded brush-like device such as that described in U.S. Pat. No. 3,757,164 to BINKOWSKI. Polarization charges in such a web are commonly controlled by subjecting the web to a corona-generated electrostatic field having the proper magnitude and polarity. It is often necessary to deal with both categories of charges.

Regulating polarization charges with a corona-generated electrostatic field is effective, but this technique has several disadvantages. A corona generates ozone gas and ozone can cause some individuals to become ill. Even if illness does not result from the ozone, it has a pungent odor that is objectional to most people, especially in an environment where ventilation is relatively poor or nonexistent. When a corona is employed to control polarization charges on a web of light-sensitive material, means must be provided to prevent light produced by the corona from reaching and thereby damaging said material. In addition, it is often necessary to expend significant quantities of relatively costly electric power in order to generate and maintain a corona-type electrostatic field for charge polarizing purposes.

Regulating polarization charges in charge retaining materials with a brush-like device having a small number of relatively coarse conductive bristles, as in U.S. Pat. No. 3,146,385 to CARLSON, may produce the desired charge level in portions of said material but the degree of charge level uniformity throughout said material would be relatively poor.

SUMMARY OF THE INVENTION

In accordance with the teachings of the present invention, apparatus is provided for establishing a relatively uniform charge level on charge-retaining materials. The apparatus includes an electrically conductive reference surface, a brush having conductive bristles or filaments with one end of each of said bristles being connected to a common electrical conductor, and a DC potential source connected between said common electrical conductor and said reference surface. The magnitude and polarity of said potential source is selected such that the proper electrostatic field is generated between said brush and said reference surface for the purpose of establishing the desired charge level on charge-retaining materials passed between said brush and said reference surface, said potential magnitude being less than that required for the generation of corona.

BRIEF DESCRIPTION OF THE DRAWINGS

FIG. 1A is a perspective view of a schematic of the charge controlling apparatus of the present invention and a moving web of charge retaining material having its electrostatic charge controlled by said apparatus.

FIG. 1B is an elevational view of a moving web and charge controlling apparatus as in FIG. 1B, wherein said apparatus additionally includes an electrostatic, charge level sensing, feedback control device.

DESCRIPTION OF THE PREFERRED EMBODIMENTS

Figure 2A:
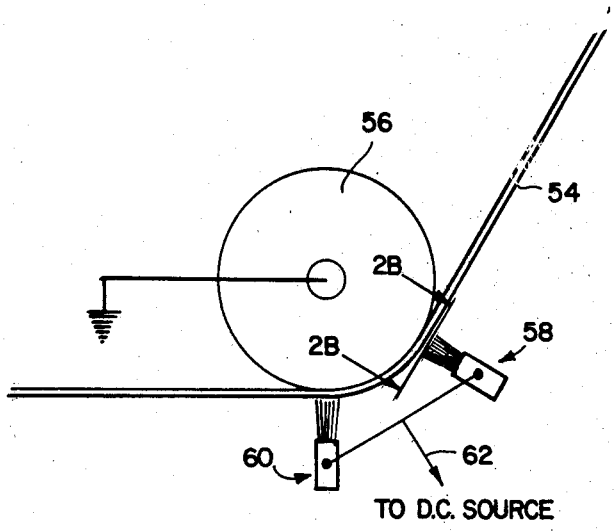
FIG. 2A is an elevational view of a moving web and electrostatic charge controlling apparatus having two parallel fed, electrostatic-field-providing brushes.

Turning now to the drawings, in FIG. 1A a perspective view of a schematic diagram of the charge controlling apparatus of the present invention and a moving web of charge retaining plastic sheet material 10 having its electrostatic charge controlled by said apparatus, are depicted. A roll of said plastic sheet or web material 10 is moved over rotatably mounted cylindrical backing rollers, 12, 14, 16 and 18 in direction 20 at the desired rate of web 10 movement by suitable drive means (not shown) coupled to said web 10.

Brush 22 is mounted in a fixed position and in a spaced relation with respect to web 10 and roller 16. The construction of brush 22 will be described below in detail. For the present, however, it should be noted that brush 22 does include a multiplicity of conductive bristles or filaments 24 with an end of each of said filaments being electrically connected to common electrical conductor 26. Backing roller 16 is constructed of electrically conductive materials and said roller 16 is connected to ground potential. DC potential source 28 is connected between common electrical conductor 26 on brush 22 and ground potential causing a relatively intense electrostatic field to be established between the free ends of bristles 24 of brush 22 and grounded roller 16. The use of the multiplicity of conductive bristles or filaments in the form of brush 22 coupled to a suitable potential source results in an electrostatic field being established with an electrical potential whose magnitude is substantially less than that necessary for the generation of corona. The reason for being able to establish a relatively intense field with a relatively low voltage will be explained below in detail.

As web 10 is moved in direction 20 over roller 16 between the free ends of bristles 24 and grounded roller 16, through the relatively intense electrostatic field established between said free ends and said roller 16, electrostatic charges retained by said web 10 are controlled or regulated by said electrostatic field. The magnitude and polarity of the potential supplied by potential source 28 is established before web 10 is so moved, by empirically determining the electrostatic field intensity necessary for the desired degree of web 10 electrostatic charge regulation.

In another embodiment of the present invention, depicted in FIG. 1B, the electrostatic charge level on moving charge-retaining web 30 is controlled by apparatus similar to that in FIG. 1A, except that an automatically variable DC potential source 32 is additionally included in said apparatus. The desired charge level on web 30 is obtained by rotating magnitude and polarity adjusting knob 34 of potential source 32 to the position where the intensity and polarity of the electrostatic field between bristles 38 of brush 36, which are connected to DC potential source 32 through path 40, and grounded backing roller 42 will produce such a charge level. As web 30 moves over grounded roller 42 in direction 44 electrostatic charge level sensor 46 generates a signal that is detected by level detector 48 through path 50 and, in turn, produces a charge level signal at its output that is routed to variable DC potential source 32 through path 52. The charge level signal on path 52 is applied to variable DC potential source 32 where it causes DC potential source 32 to automatically correct any error or charge level difference between the desired charge level as set by knob 34 on source 32 and the actual charge level as sensed by electrostatic charge level sensor 46.

In the apparatus of FIGS. 1A and 1B, brushes 22 and 36 are spaced a finite distance from the moving charge-retaining web whose electrostatic charge level they are regulating. By so spacing said brushes from their associated moving webs the magnitude of the potential applied to said brushes must be increased in order to obtain the same electrostatic field intensity over an arrangement where brushes 22 or 36 were in actual contact with their associated webs. This is so because the brush to web spacing introduces an electrical impedance or resistance to the generation of an electrostatic field between these components. The electrostatic charge level on webs 10 and 30 can be properly regulated at lower DC potentials when brushes 22 and 36 are in direct contact with said webs 10 and 30, respectively. However, scratching of the surface of the webs 10 and 30 may occur and such scratching may render these webs useless for incorporation in an end product.

Brushes that are utilized to control the charge level on charge retaining materials such as webs 10 and 30 in FIGS. 1A and 1B usually have a bristle or a filament density in excess of 120 K filaments per square inch and preferably in excess of 150 k filaments per square inch. The number of square inches of brush filaments and the physical dimensions of a particular brush are determined by considering such factors as the speed of web movement, the initial web charge level and the type of material of which the web is formed. If, as in the charge regulating arrangement of FIG. 2A, a web such as web 54 is moved over roller 56 at a relatively high rate of speed, it may be necessary to employ two or more brushes such as brushes 58 and 60, and space them about the circumference of said roller 56 if a single brush is insufficient to establish the desired web charge level. Brushes 58 and 60 would then connect to a common DC potential source through, for example, path 62.

Figure 2B:
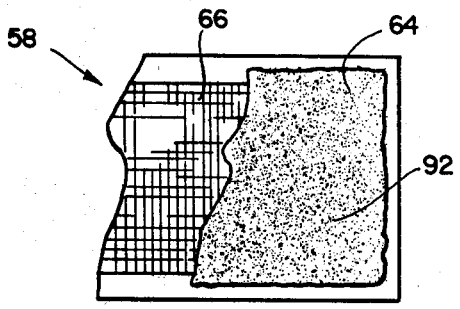
FIG. 2B is an enlarged fragmented, cross sectional view taken on the line 2B—2B in FIG. 2A.

The construction of a typical electrostatic charge controlling brush, such as brush 58 in FIG. 2A, will now be explained in detail with reference to FIGS. 2A, 2B, 2C and 2D. In FIG. 2B, which is a fragmentary cross-sectional view taken on the line 2B—2B in FIG. 2A, the free ends of a multiplicity of conductive bristles 64 of uniform diameter, are depicted. The opposite end of these bristles 64 are firmly attached to electrically conductive mesh 66. Conductive mesh 66 constitutes a common electrical conductor that is connected to a DC potential source through, for example, path 62 in FIG. 2A. A portion of a single conductive bristle or filament 68 of the multiplicity of conductive bristles 64 is shown, in elevation, in FIG. 2C. In addition, a cross-sectional view of said filament 68 taken on the line 2D—2D is shown in FIG. 2D. Filament 68 is cylindrical in cross section as are all of the multiplicity of filaments 64, with the end surface 70 and the cylindrical surface 72 along the length of said filament 68 intersecting at an angle 74 of 90 degrees. Bristles 64 are normally constructed of conductive nylon or stainless steel. However, any conductive material having a resistance of 500 megohms or less may be employed as bristle material. Low resistances are not necessary because, unlike a corona generated field, only a minute amount of current is utilized; primarily because of leakage and for polarization.

Surface 70 of filament 68 is spaced from moving web 54 and a relatively intense electrostatic field 76 is produced between the intersection of said surfaces 70, 72 and grounded backing roller 56. It is a well-known electrical phenomenon that more intense electrostatic fields can be generated at a sharp or small radius ($\approx 0$) of curvature surface for the same applied potential than at a smooth or a large radius curvature surface.

Figure 2C:
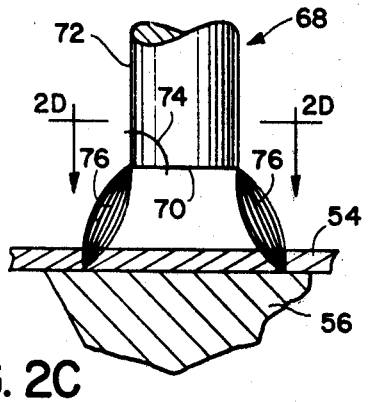
FIG. 2C is an enlarged elevational view of a portion of a single brush bristle, a web and a backing roller of the type shown in FIG. 2A.
Figure 2D:
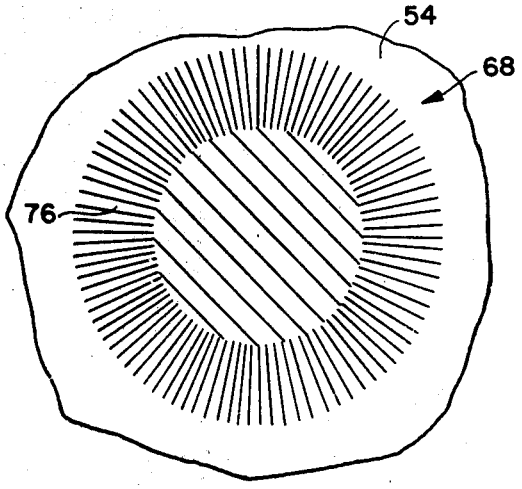
FIG. 2D is an enlarged cross sectional view taken on the line 2D—2D in FIG. 2C.

In the interest of clarity, only a portion of complete electrostatic field 76 is shown in FIG. 2C. A more complete representation of electrostatic field 76 is shown in the cross-sectional view of filament 68 illustrated in FIG. 2D. A portion of electrostatic field 76 also exists between flat surface 70 of filament 68 and the upper surface of backing roller 56. However, the relatively low intensity of this portion of said field 76 is substantially less effective in regulating electrostatic charges than that portion of electrostatic field 76 present at the periphery of said surface 70. In order to produce an electrostatic field between surface 70 of filament 68 and backing roller 56 that would adequately regulate electrostatic charges on moving web 54, the magnitude of the potential between filament 68 and grounded backing roller 56 would be so large than an undesirable corona would be generated at either said filament 68 or said roller 56, depending upon the polarity of these components. A bristle, such as bristle 68 in FIGS. 2C and 2D can be utilized to produce the desired electrostatic field intensity to properly regulate electrostatic charges on a moving web at DC potential levels that are substantially below the approximately 3.5 DC KV level where a corona would normally first appear and usually at less than half said potential magnitude.

Figure 3A:
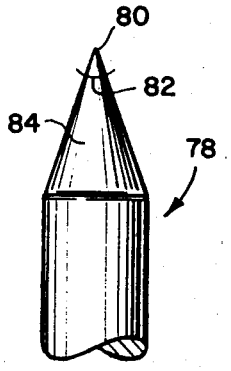
(PRIOR ART) FIG. 3A
FIG. 3A is a partial elevational view of a conventional, electrically conductive electrode of the type used for corona-type electrostatic field generation.

In prior art corona-type electrostatic charge controlling apparatus, a plurality of electrical conductors or electrodes of circular cross-section and pointed at one end, such as electrode 78 in FIG. 3A, were electrically connected to a common, corona-generating, DC potential source. The electrodes were usually made of copper or brass, were approximately 0.5 mm in diameter and were linearly spaced approximately 2 cm from each other across the width of a moving web whose retained electrostatic charge was to be regulated.

Figure 3B:
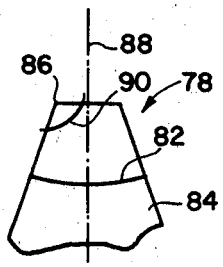
(PRIOR ART) FIG. 3B
FIG. 3B is an enlarged view of the pointed tip of the electrode shown in FIG. 3A.

On initial examination of pointed tip 80 of electrode 78 in FIG. 3A, without the aid of optical instruments, it would appear that angle 82 of said pointed tip 80, formed by conical surface 84, was smaller than angle 74 of filament 68 formed by intersecting surfaces 70/72 in FIG. 2C. If said angle 82 were, in fact, smaller than said angle 74, one would expect to be able to generate a more intense electrostatic field, for the same applied potential, at tip 80 of electrode 78 than electrostatic field 76 produced between bristle 68 and backing roller 56 in FIG. 2C. In practice, however, the DC potential applied between electrode 78 and a reference grounded surface must be far in excess of that applied between bristle 68 and backing roller 56 in FIG. 2C in order to achieve the same electrostatic field intensity. This is so because when tip 80 of electrode 78 in FIG. 3A is examined with the aid of optics its shape closely resembles that shown in FIG. 3B. As shown in FIG. 3B, which is an enlargement of tip 80 in FIG. 3A, generally planar surface 86 is the actual shape of tip 80 of electrode 78, and said planar surface 86 is approximately at right angles with respect to longitudinal axis 88 of said electrode 78. This being so, the significant angle at tip 80 of electrode 78 in FIGS. 3A and 3B is not angle 82 formed by conical surface 84. In point of fact, the most significant angle at tip 80 of electrode 78 is angle 90 formed by conical surface 84 and planar surface 86. Angle 90 is approximately 130 degrees and is substantially larger than the approximately 90 degrees angle of angle 74 in FIG. 2C formed by intersecting surfaces 70/72. As previously explained, the smaller the radius of curvature the lower the electrical potential necessary for producing a particular electrostatic field intensity. With a larger scale and its attendant larger radius of curvature, substantially more electrical potential must be applied to electrode 78 in FIGS. 3A and 3B than to bristle 68 in FIG. 2C, when equally spaced from a grounded reference surface, in order to produce the same electrostatic field intensity. With respect to bristle 68 in FIG. 2, the desired electrostatic field intensity for regulating electrostatic charges on a charge-retaining web can be obtained with a potential source connected to said bristle 68 that is well below the magnitude necessary for corona generation, a magnitude that is often in the neighborhood of 1500 volts DC.

When the diameter of bristles 64 (FIG. 2B) are relatively large (2.0 mils or greator) the size of angle 74 (FIG. 2C) begins to assume importance for low voltage electrostatic field generation. However, when bristle diameters become extremely small said angle 74 becomes relatively unimportant because the entire free end of said bristles form a very small radius of curvature surface that acts as a point source from which an electrostatic field can readily be established.

DISCUSSION

Electrostatic charges regulated by the charge controlling apparatus of the present invention are primarily those resulting from dipole orientation. Dipoles that are fairly well aligned with respect to one another produce a relatively high or strong electrostatic charge level in charge-retaining materials whereas dipoles that are disoriented or grossly misaligned with respect to one another produce a relatively low or weak electrostatic charge level in such materials. Dipole orientation between either of these two extremes would, of course, produce corresponding electrostatic charge levels somewhere between the charge levels produced at said extremes. This dipole orientation and electrostatic effects resulting from the orientation thereof is fairly well understood in the prior art.

The relatively intense dipole orienting electrostatic field produced by a single bristle such as bristle 68 in FIG. 2C would be insufficient, by itself, to have any meaningful effect on the control or regulation of a significant portion of the electrostatic charge level on most charge-retaining materials. At best, such a single filament may regulate the charge level to the desired magnitude along a very thin line of charge-retaining material as said material was moved past said single filament.

On the other hand, an electrode in the form of a flat plate supported over charge-retaining materials for charge regulation purposes would require an extremely large-magnitude potential source, a magnitude that would cause corona. The inventive concept of the present invention is to increase the density or number of bristles per square inch to the largest density possible but not so large that a plane passed through said bristles at right angles to their longitudinal axes would appear as a solid flat plate, without any openings therein. The smallest diameter possible for a bristle in a conductive bristle poling brush, such as brush 58 in FIG. 2B, appears to be in the vicinity of one micron. Conductive bristle brushes having bristle diameters of 50 microns or less are particularly useful as poling brushes because of the extremely uniform charge levels that such bristle produce on charge-retaining materials.

Figure 4:
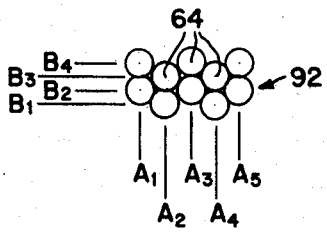
FIG. 4 is an enlarged detail of a portion of the conductive bristles depicted in FIG. 2B.

Poling brush 58 of FIG. 2B includes a multiplicity of bristles 64, having the same diameter, arrayed in a pattern that approximates a row and column grid when viewed from the free ends of said bristles as shown in said FIG. 2B. An enlarged detail 92 of a portion of bristles 64, as shown in FIG. 2B, is depicted in FIG. 4. As shown in detail 92 of FIG. 4B, bristles 64 are arranged in columns $A_1$ through $A_5$ and rows $B_1$ through $B_4$ with rows $B_2$ and $B_4$, for example, being laterally offset from rows $B_1$ and $B_3$. By offsetting bristle rows, greater compacting and relatively high bristle densities can be obtained. It is not essential that the rows and columns of bristle 64 shown in FIG. 4 be perfectly straight for the proper operation of poling brush 58 so long as the required degree of bristle compaction and bristle density is obtained. Rows and columns of bristles of the size and densities mentioned above produce the electrostatic field strength that is necessary for low (less than corona) voltage electrostatic charge regulation.

Poling brushes such as brush 58 in FIG. 2B require large numbers of bristles arrayed in two generally perpendicular directions because of differences in bristle length that are not easily avoided. If two adjacent conductive bristles have significantly different lengths, the longer bristle or the one that is closer to a reference surface will be the one that produces the desired dipole orienting electrostatic field. The shorter of said two conductive bristles would contribute very little to the orientation of dipoles and may actually cause an electrostatic field void. By employing a brush with a multiplicity of conductive bristles, enough "long" bristles will be included to provide the required electrostatic field across the width of, for example, a moving web of charge-retaining material and produce the desired uniform electrostatic charge level on said material.

By utilizing the multiplicity of filaments such as in brush 58 of FIGS. 2A and 2B in the manner described, dipole orientation in charge-retaining materials and the electrostatic charge level resulting therefrom can readily be regulated. The number of poling brushes may have to be increased as in FIG. 2A, or the width of the particular poling brush may have to be varied to achieve the desired electrostatic charge level. However, the desired charge level can be produced in charge-retaining materials with DC potentials that are substantially less than that necessary to generate a corona, by utilizing the electrostatic charge regulating apparatus of the present invention or variations thereof.

When subjecting charge-retaining materials to the electrostatic field produced by the electrostatic charge regulating apparatus of the present invention for the desirable effect of regulating electrostatic charge levels by orienting dipoles, an undesirable change in the electrostatic charge level resulting from the change in the number of free surface charges produced by said dipole orienting or poling process will often occur. In order to control the extent to which the number of free surface charges increase during the poling process, a conductive bristle brush like that described in the above-mentioned BINKOWSKI patent may be utilized in addition to the conductive bristle brush used in the poling process of the present invention. Such an arrangement is shown in FIG. 5.

Figure 5:
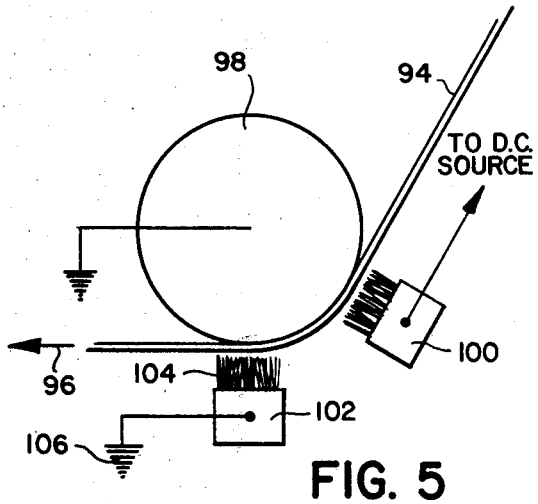
FIG. 5 is an elevational view of a moving web and electrostatic charge controlling apparatus having one brush connected to a DC potential source and a separate brush connected to ground potential.

In FIG. 5, as charge-retaining material or web 94 is moved in direction 96 over grounded backing roller 98, it is initially subjected to a relatively intense electrostatic field between poling brush 100, which is connected to a suitable DC potential source, and said backing roller 98. As web 94 continues to move in the same direction over grounded backing roller 98 between a grounded BINKOWSKI-type brush 102 and said backing roller 98, free charges on the surface of web 94 will discharge or pass through filaments 104 of brush 102 into ground or reference point 106 to which said filaments are electrically connected. Web 94 is preferably moved past grounded brush 102 after being subjected to poling brush 100. However, effective control of free charges can be achieved by discharging free charges on a moving web before said web is subjected to the electrostatic field provided by a brush polarizer.

It will be apparent to those skilled in the art from the foregoing description of my invention that various improvements and modifications can be made in it without departing from its true scope. The embodiments described herein are merely illustrative and they should not be viewed as the only embodiments that might encompass my invention.

What is claimed is:

1. Apparatus for establishing a uniform dipole-type electrostatic charge on plastic dielectric materials, comprising:

a first common electrical conductor;

means for establishing an electrically conductive reference surface;

a first multiplicity of electrically conductive elongated bristles, formed of a high conductivity electrically conductive material supported over said reference surface with one end of said bristles being in an electrically coupled relation to said first common conductor, said bristles extending from their said one end toward said reference surface with the free ends of said filaments being adjacent said reference surface and with the positional relationship of said free ends approximating a row and column grid-like pattern; and a DC potential source connected between said common electrical conductor and said reference surface, said potential source having a predetermined magnitude and polarity for establishing an intense electrostatic field and for adjusting the dipole-type electrostatic charge to the desired charge level on plastic dielectric material passed between said free bristle ends and said reference surface, and in a spaced relation from said free bristle ends.

2. The apparatus of claim 1, wherein adjacent rows in said row and column grid-like structure are offset from one another.

3. The apparatus of claim 1, wherein the density of said bristles on said support is equal to or greater than 120 thousand bristles per square inch.

4. The apparatus of claim 1, wherein the diameter of said first multiplicity of bristles is equal to or less than 50 microns.

5. The apparatus of claim 1, wherein the electrical resistance of an individual bristle of said first multiplicity of bristles is equal to or less than 500 megohms.

6. The apparatus of claim 1, wherein a portion of the surface along the length of said bristles and a portion of the surface along the end of said bristles intersect at an angle of less than one hundred and thirty degrees.

7. The apparatus of claim 1, wherein a portion of the surface along the length of said bristles and a portion of the surface along the end of said bristles intersect an an angle equal to or less than ninety degrees.

8. The apparatus of claim 1, wherein said reference surface is in contact with plastic dielectric material passed between said free ends of said first multiplicity of bristles and said reference surface.

9. The apparatus of claim 1, wherein said bristles are formed of stainless steel.

10. The apparatus of claim 1, wherein said bristles are formed of conductive nylon.

11. The apparatus of claim 1, further comprising:

a second common electrical conductor;

a second multiplicity of electrically conductive elongated bristles supported over said reference surface with one end of said bristles being in an electrically coupled relation to said second common conductor, with said second electrical conductor being electrically coupled to ground potential and with free electrostatic charges accumulated on the surface of charge-retaining material being removed from said material when moved between the free ends of said second multiplicity of bristles and said reference surface.

12. A method of establishing a uniform, dipole-type electrostatic charge on plastic dielectric materials, comprising the steps of:

mounting a multiplicity of electrically conductive elongated bristles formed of high conductivity electrically conductive materials over a reference surface with one end of said bristles in an electrically coupled relation to a common conductor and the free ends thereof adjacent said reference surface, the positional relationship of the free ends of said bristles approximating a row and column grid-like pattern;

connecting a DC potential source having a particular magnitude and polarity between said common electrical conductor and said reference surface to establish a desired electrostatic field between the free ends of said bristles and said reference surface; and moving a plastic dielectric material through said electrostatic field between said free bristle ends and said reference surface in a spaced relation from said free bristle ends to thereby establish said desired uniform electrostatic charge level on said dielectric material.

* * * * *